United States Patent [19]

Warman

[11] Patent Number: 4,666,147

[45] Date of Patent: May 19, 1987

[54] INVERT DIVING PLATFORM

[76] Inventor: Richard B. Warman, P.O. Box 842, Loxahatchee, Fla. 33470

[21] Appl. No.: 776,101

[22] Filed: Sep. 16, 1985

Related U.S. Application Data

[63] Continuation of Ser. No. 591,048, Mar. 19, 1984.

[51] Int. Cl.[4] ..... A63B 5/10; A63G 21/18

[52] U.S. Cl. ..... 272/66; 272/56.5 R; 182/115; 403/344

[58] Field of Search ..... 272/65, 66, 56.5 R; 403/344; 182/115, 116, 120, 121, 122, 123, 118; 248/250, 210, 211, 230, 201

[56] References Cited

U.S. PATENT DOCUMENTS

| | | | |
|---|---|---|---|
| 1,118,385 | 11/1914 | Timmerman | 182/121 X |
| 1,179,661 | 4/1916 | Selah | 403/344 X |
| 1,351,053 | 8/1920 | Macklem | 182/116 X |
| 3,182,749 | 5/1965 | Girardello | 182/120 |
| 3,362,708 | 1/1968 | Densmore | 272/66 |
| 3,964,572 | 6/1976 | Gannon | 182/118 X |

FOREIGN PATENT DOCUMENTS

| | | | |
|---|---|---|---|
| 2358876 | 2/1975 | Fed. Rep. of Germany | 272/65 |
| 1124798 | 7/1956 | France | 248/230 |

*Primary Examiner*—Robert A. Hafer
*Assistant Examiner*—Arnold W. Kramer
*Attorney, Agent, or Firm*—Eugene F. Malin

[57] ABSTRACT

An invert diving platform affixed to the structure of a common pool ladder anchored to the deck of a pool for providing an elevated platform above the water level for diving. The platform is rigidly attached to the parallel railings of the ladder in a generally horizontal position. The platform is rigidly attached to the curved rungs by two pair of opposed clamps attached to opposed ends of the platform. The clamps are vertically adjustable on the railings of the ladder to allow adjustment of the height of the platform. The clamps attach to railings having various shapes, dimensions and angles to provide rigid support for the platform. An incline plane may be attached to the platform at an angle descending into the pool to provide a slide. A bracing member is connectable to the steps of the pool ladder to provide horizontal stability.

2 Claims, 5 Drawing Figures

INVERT DIVING PLATFORM

This application is a continuation, of application Ser. No. 591,048, filed 3/19/84.

BACKGROUND OF THE INVENTION

In recent years there has been a dramatic increase in the number of in-ground swimming pools being built as an adjunct to residential homes. The pool size common to residential homes usually precluded the installation of a cantilevered diving board generally as a result of the price, depth of pool required or lack of interest of the purchaser. Subsequent demand for an elevated diving platform generally arose after continued use of the pool in order to expand the use and enjoyment of the pool.

SUMMARY OF THE INVENTION

The railings of the existing common pool ladder are used to support a platform, slide or combination platform and slide. The use of the instant invention allows a diving platform or slide to be added to an existing pool without any additional construction or expense. Two pair of opposing clamps attach to a portion of the railings to provide attachment of the platform to the railings. Support members extend from each of the four clamps to support the platform. The support members insert into aperatures along the side of the platform. The support members are of sufficient length to provide adjustment to accommodate varying distances between the railings of the pool ladder. A bolt-like fastener connects the two halves of each clamp to hold it rigidly to the railing to provide rigid support to the platform so as to support the weight of an individual. In a similar manner a slide means is attached to the platform for support. A step apparatus may be added to permit ascent to the platform. The height of the platform on the pool ladder railings will only be limited by the configuration of the railings of the pool ladder. Various configurations of the railings are utilized however the width of the ladder is generally standard so that the width of the platform should accommodate almost any pool ladder. The platform shall also have varying apertures to accommodate the support members of the clamps so the length of the platform should be adaptable to any pool ladder. The slide connects to the platform and is further braced by connection with the lower portion of the ladder to provide stability.

An objective of this invention is to provide a platform for attachment to most common pool ladders.

An objective of this invention is to provide a platform apparatus for adjustable attachment to railings of most common pool ladders.

An objective of this invention is to provide a clamping means connectable to the railings of most common pool ladders for suporting a horizontal platform.

An objective of this invention is to provide a slide attachable to the platform to provide angled descent into the pool.

DETAILED DESCRIPTION OF THE PREFERRED EMBODIMENT

Figure 1:
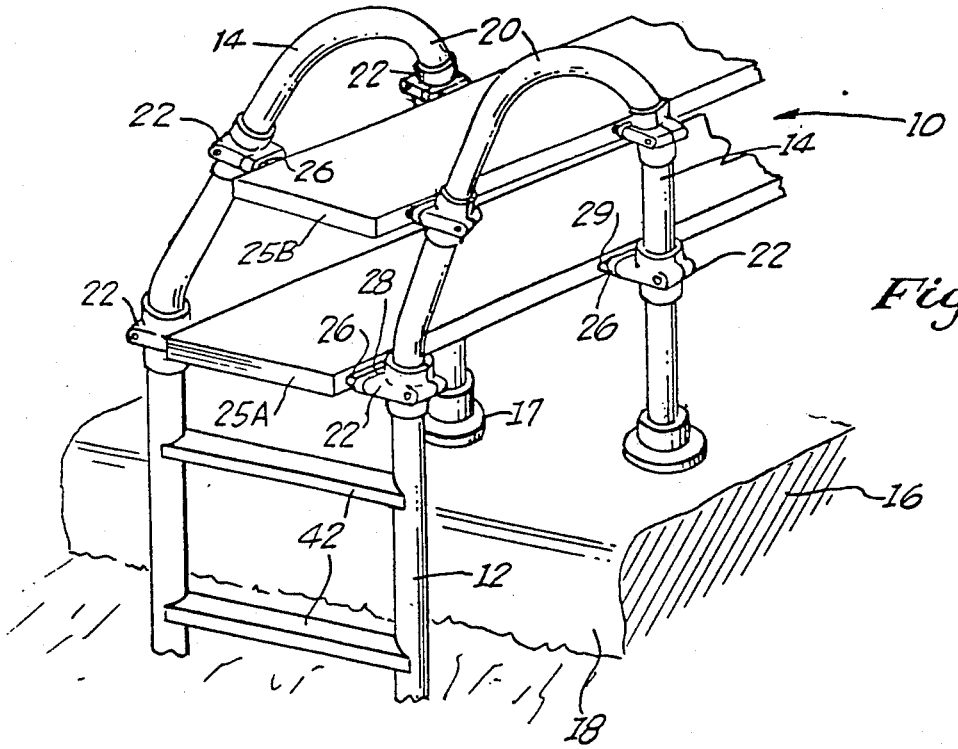
FIG. 1 is a perspective view of the invention.
Figure 2:
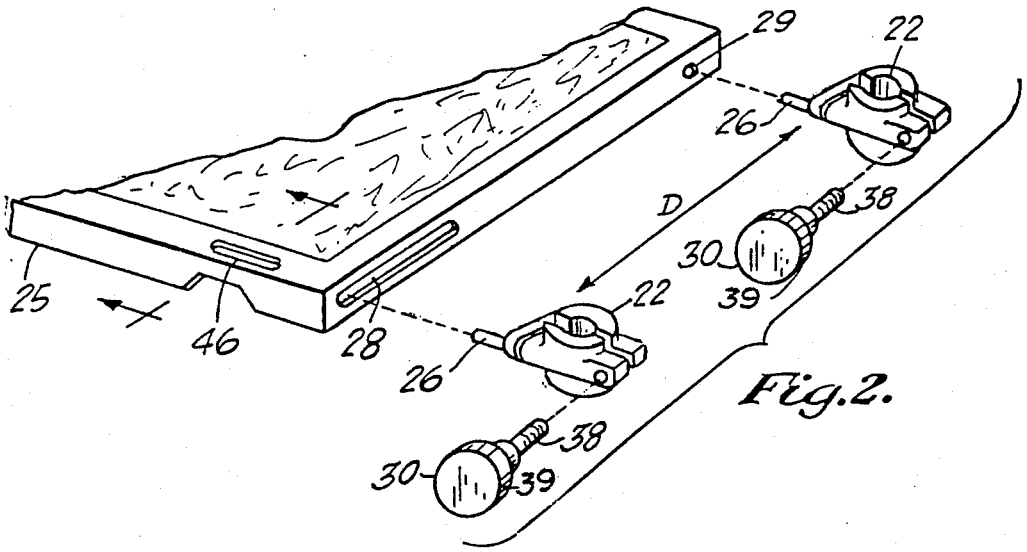
FIG. 2 is a perspective view of the platform and clamps.
Figure 3:
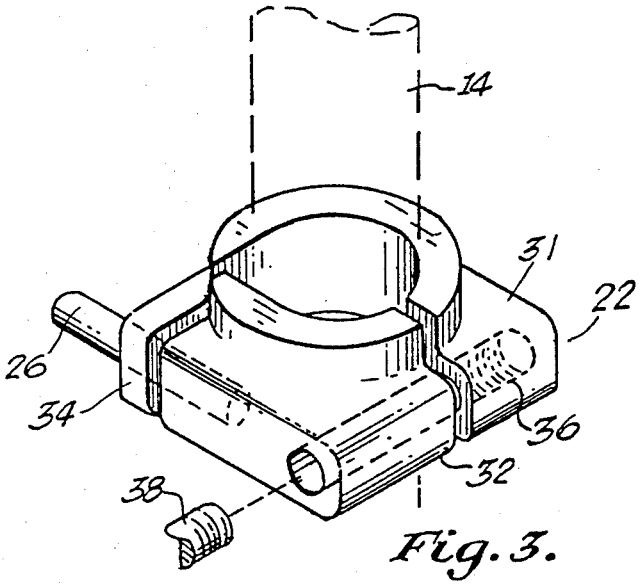
FIG. 3 is a perspective view of the clamp.

Referring now to the drawings, specifically FIGS. 1, 2 and 3, the diving platform apparatus is generally shown as 10. Common pool ladder 12 consists of a pair of generally parallel U-shaped railings 14 extending upward a distance from pool deck 16, where it is anchored at point 17, and then curving downward below the pool water level 18. The inverted generally U-shaped members 14 each include vertically extending structural portion with a plurality of spaced horizontal rungs attached. A vertically extending stanchion is attached to the pool deck 16 rearwardly of the strutural portion and is substantially aligned therewith. The free ends of each structural portion and the stanchion portion are connected by a curved portion thereby defining a pair of generally inverted U-shaped member. The upper curved 20 of railing 14 supports the diving platform apparatus 10. Two pair of opposed matching clamping means 22 are rigidly affixed to the portion 20 of each railing 14 to provide a base for supporting platform 25. In FIG. 1 is shown two separate applications of the diving platform 10 locating the platform 25 at two positions on the pool ladder 12 to demonstrate its versatility in providing a stable platform at varying heights and shapes of the railings. The platform 25A is attached to the vertical portions of railing 14. Platform 25B is attached to one vertical portion of the railing and one portion which is curved or angled. In either configuration the clamp means 22 provides a support member 26 which is horizontal and generally at a right angle to the railing 14 no matter the angle of the railing 14. The distance between the opposed clamps 22 provides a broad supporting base for the platform 25.

Connected to each clamping means 22 is a support member 26 as shown in FIG. 2 extending outward from the clamp 22. Support member 26 adjustably inserts into platform 25 at apertures 28 and 29 to accommodate varying sizes and dimensions of the ladder railings 14. As shown in FIG. 2 the preferred embodiment of aperture 28 and 29 of platform 25 is that at least one aperture be elongated to accommodate the various distances D between clamps 22. An adjustable connecting means such as a bolt 30 is used to rigidly fasten the two portions of clamping means 22 to rigidly support platform 25.

The clamping means 22 is constructed such that attachment to any portion of the railing 14 will allow the support member or stud 26 to be horizontal and generally perpendicular to the railing 14 (as shown in FIG. 1). It is preferred that only one aperture 28 or 29 be elongated so that platform 25 does not move horizontally when being retained by support member 26. However, other means may be utilized to retain platform 25 in a rigid position to provide a stable platform 25.

FIG. 3 shows the two portions 31 and 32 of clamping means 22. Support member 26 is attached to portion 32 and extends through an aperture 34 of portion 31 for insertion into platform 25 as shown in FIG. 2. Channel 36 is a threaded passageway through portion 31 for fastening portions 31 and 32 rigidly about railing 14. Bolt means 30 has a cooperating threaded portion 38 attached to handle 39 for grasping and turning the bolt means. The threaded cooperation between channel 36 and portion 38 provides tightening of the clamp 22 about railing 14. Support member 26 holds portion 31 rigidly while bolt means 30 compels portion 32 to move inward to securely fasten about railing 14. Channel 36 may extend completely through portion 31 to provide maximum travel for portion 38 thereby providing maximum adjustment for clamping means 22.

Figure 4:
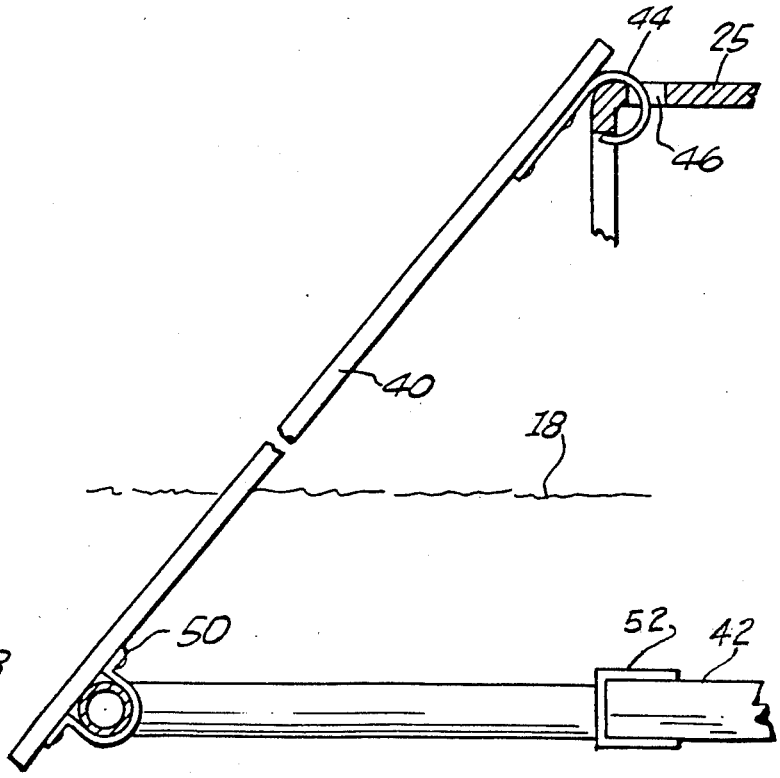
FIG. 4 is a side elevational view of the platform and slide with bracing apparatus along the plane 4—4 of FIG. 5.

FIG. 4 provides a side view of a slide attached to platform 25 and braced against one of the plurality of step 42.

Figure 5:
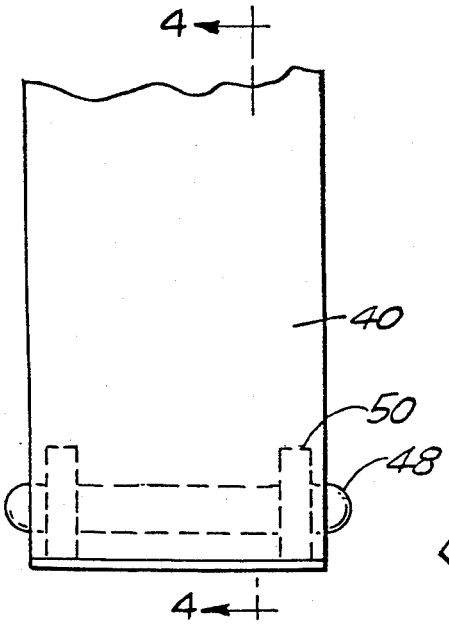
FIG. 5 is a front elevational view of the slide and brace apparatus.

Slide 40 is an inclined plane which is attached to platform 25 by such means as a hook 44, attached to slide 40, inserted through aperture 46 to provide vertical support. Horizontal support and stability is provided by a brace 48 which is rotatably connected to the lower end of slide 40 by brackets 50 and connects to step 42 by a U-shaped end connector 52 for slideable insertion over step 42. Brace 48 is rotatable within brackets 50 to accomodate connection with a step 42 at a position adjacent to slide 40. FIG. 5 is a front view of slide 40 showing the positions of brackets 50. Brace 48 is preferably a U-shaped brace having two separate attachment points on slide 40 at two brackets 50 as shown in FIG. 5 and two end connectors 52 attaching to the step 42 of pool ladder 12 as shown in FIG. 4 at separated positions to provide a stable horizontal brace for the lower end of slide 40 to prevent rotation of slide 40 about its inclined longitudinal axis. The length of brace 48 may be varied to adjust the incline of slide 40.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. Apparatus for attachment to support structure as an inverted U-shaped ladder exiting a swimming pool and attached to the pool deck comprising:

four clamping means, each having a pair of clamping members, one of said clamping members having a projecting stud at one end for projection through and beyond an opening in the corresponding end of the other member, means at the opposite ends of said members for drawing said clamping members together to clamp onto support structure;

a platform having a first pair of horizontally opposed openings through the side edges thereof slightly larger than the cross-section of the projecting studs, and a second pair of horizontally opposed openings through the side edges thereof, said second pair of openings being elongated slots to permit said platform to be substantially universally adjustable about the horizontally opposed projecting studs projecting therethrough depending upon the vertical displacement of the clamping means when clamped to the support structure with pairs of said studs opposed.

2. Apparatus as in claim 1 further including:

a slide having means at its top end to relesably connect with connecting means on one end of said platform, and having brace means pivotally connected at one end to the lower end of said slide and having means on its other end to cooperate with the structure so as to maintain said slide in an inclined attitude.

* * * * *